United States Patent [19]

Sharp

[11] Patent Number: 4,869,386

[45] Date of Patent: Sep. 26, 1989

[54] DOUBLE WALLED STORAGE TANK HAVING A RIBBED APPEARANCE

[76] Inventor: Bruce R. Sharp, 4090 Rose Hill Ave., Cincinnati, Ohio 45229

[21] Appl. No.: 290,361

[22] Filed: Dec. 27, 1988

[51] Int. Cl.[4] ..... B65D 87/00

[52] U.S. Cl. ..... 220/5 A; 220/83; 220/469

[58] Field of Search ..... 220/5 A, 1 B, 445, 453, 220/465, 466, 469, 72, 83; 73/49.2

[56] References Cited

U.S. PATENT DOCUMENTS

| | | | |
|---|---|---|---|
| 3,335,903 | 8/1967 | Anderson | 220/83 |
| 3,335,904 | 8/1967 | Anderson | 220/83 |
| 3,700,512 | 10/1972 | Pearson et al. | 156/62.4 |
| 4,004,706 | 1/1977 | Guldenfels et al. | 220/83 X |
| 4,561,292 | 12/1985 | Pugnale et al. | 73/49.2 |
| 4,640,439 | 2/1987 | Palazzo | 220/445 |
| 4,651,893 | 3/1987 | Mooney | 220/469 X |
| 4,715,513 | 12/1987 | Shelton, Jr. | 220/5 A X |
| 4,778,075 | 10/1988 | Wiegand et al. | 220/83 X |
| 4,780,946 | 11/1988 | Palazzo | 220/445 X |
| 4,781,777 | 11/1988 | Pugnale et al. | 73/49.2 T X |

*Primary Examiner*—Steven M. Pollard

*Attorney, Agent, or Firm*—Charles R. Wilson

[57] ABSTRACT

A method of making a storage tank system comprises forming an outer containment wall comprised of a series of outer wall sections over a cylindrical-shaped inner storage tank. Each outer wall section is bonded to the inner tank's side wall at a distance of less than about four inches in height from the inner tank wall. The inner and outer walls of the system are both strengthened by wall caps which overlap the outer wall sections. Secondary containment is provided by the outer wall sections, wall caps and outer end caps. A monitored storage tank system with secondary containment is provided by the use of a leak detection means to monitor the closed space defined by the outer containment wall and the inner storage tank.

25 Claims, 3 Drawing Sheets

DOUBLE WALLED STORAGE TANK HAVING A RIBBED APPEARANCE

This invention relates to storage tanks. More particularly, the invention relates to underground storage tanks which are double walled.

BACKGROUND OF THE INVENTION

Commercial and industrial storage tanks are widely used for storing a great variety of liquids. Some of these liquids are highly corrosive and/or are flammable. The service life of a storage tank will vary, depending upon environmental conditions, including the liquid being stored. Eventually, however, the tank will become corroded and develop leaks. This can result in a significant danger to the environment and health of nearby residents. For example, storage tanks are commonly used for storing gasoline at service stations. Gasoline, of course, is highly-flammable and is capable of posing a significant health and safety hazard if not properly contained. Federal as well as local regulations govern the structure of such storage tanks.

Heightened public awareness of the danger posed by storage tanks (particularly underground gasoline storage tanks) has led to additional governmental regulations. Recent proposed regulations 2 will soon require most storage tanks to have secondary containment means and possibly a fail safe design feature to guard against accidental soil, water, and air contamination. Secondary containment means must be capable of containing leaked liquid from the storage tank. Rigid double walled tanks made from sheet metal have been suggested as one alternative. While effective for containment purposes, such tanks as presently available are costly to build and difficult to install because of their weight. The tanks are built by basically forming two rigid tanks and placing one inside the other. Tanks made from fiberglass reinforced resinous material are also extensively used. Building a double walled storage tank system with fiberglass and resin by known methods is very labor intensive and costly.

Recent concerns about tank leaks has heightened the need for an efficient and economical manner of building double walled storage tank systems. There has now been discovered a method whereby storage tanks are built with a double wall for secondary containment in an efficient, yet economical manner. Such tanks can also be equipped with means to monitor for any leakage.

SUMMARY OF THE INVENTION

A method of building a strengthened double walled storage tank system comprises initially forming over a cylindrical-shaped inner storage tank a series of spaced outer wall sections. Each wall section extends circumferentially around the inner storage tank and each section is at least partially attached along its edges to the inner storage tank. Next, open-bottom wall caps are attached to adjacently spaced outer wall sections such that a first side wall of the cap is attached to one wall section and a second side wall of the cap is attached to the other wall section. Finally, outer end caps are positioned at the ends of the inner storage tank and attached. The outer wall sections, open-bottom wall caps and outer end caps are all secured together in a liquid tight fashion to collectively form an outer containment wall.

DETAILED DESCRIPTION OF THE INVENTION

Figure 1:
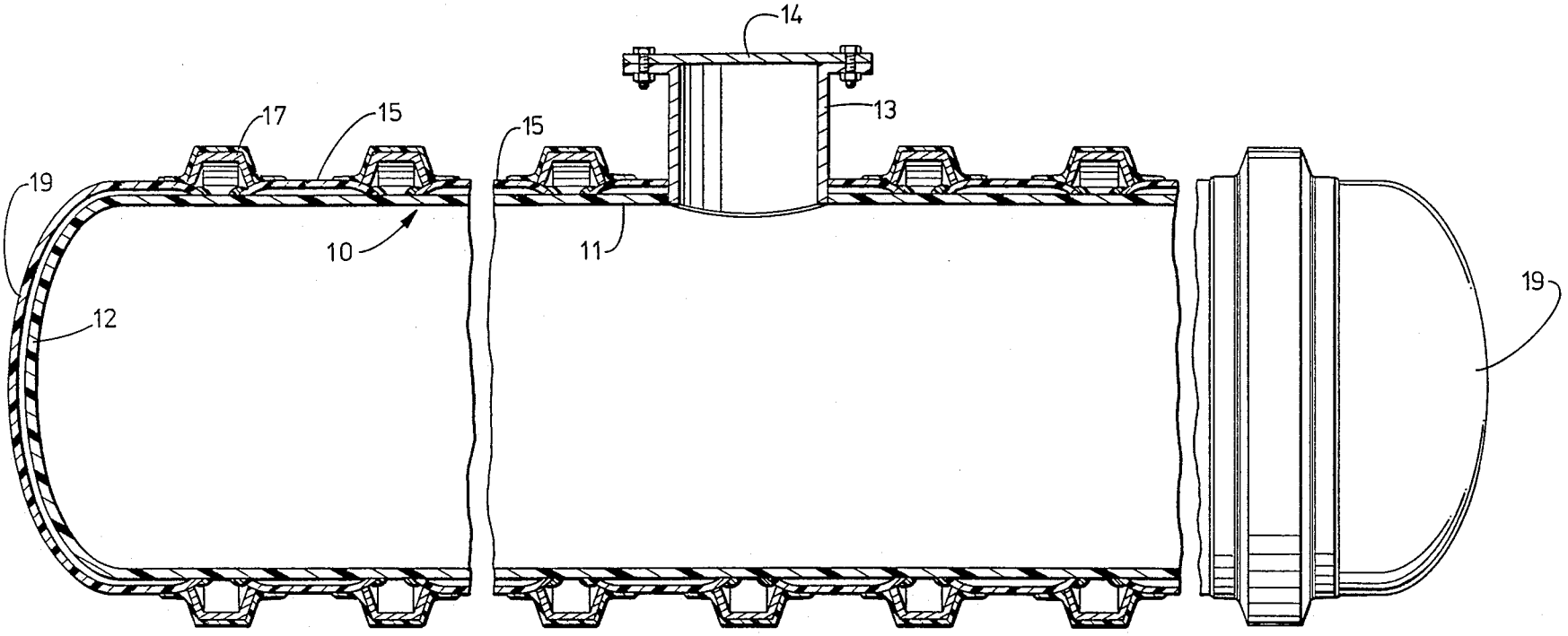
FIG. 1 is a side view of a double walled storage tank system of this invention

With reference to FIG. 1, there is shown a double walled storage tank system. The inner storage tank 10 of the type shown in FIG. 1 is well known and is widely used, especially in the gasoline service station industry. Such tanks comprise a main cylindrical-shaped body 11, end walls 12, and manway 13. Main body 11 and end walls 12 are made of steel or a conventional fibrous reinforced resinous material. Not illustrated but within the spirit of this invention ar those tanks wherein the end walls are flat and those tanks not having manways.

A sufficient number of openings are found in the storage tank 10 to allow for various access lines to the interior of the tank. For instance, a fill pipe, dispensing line and vent pipe can enter the storage tank at various points in the tank's surface, but preferably all enter through cover 14 of manway 13.

In accord with this invention, initially a series of spaced outer wall sections 15 are formed over the inner storage tank. The wall sections extend circumferentially around the inner storage tank. Each section is attached at least partially along both of its edges to the storage tank. The mid portions of the sections between the edges are not attached to the tank so that an open space 16 exists under each wall section. The outer wall sections extend less than about four inches in height from the inner tank wall, preferably from about 1/64 inch to about ¼ inch. Because of manufacturing difficulties, portions of the wall sections may contact the inner tank wall 10. Such contact is not detrimental to the storage tank system's performance provided the two walls remain at least partially separated i.e. they are not sealed together. The open areas 16 provide an annular containment area for receiving liquid which may leak through the inner storage tank's walls.

The width of an outer wall section 15 ranges from about eight inches to about sixty inches. The preferred width of a section is from about twelve inches to about thirty-six inches. The most preferred width for each outer wall section is from about fourteen inches to about twenty inches. About two to six inches, preferably about three to about five inches separate the individual outer wall sections. The preferred wall section widths and spacing varies based on structural design and size of the tank. The aforementioned preferred widths are for a storage tank having a diameter of from about four feet to about twelve feet.

The outerwall section edges can be attached along their entire lengths to the inner storage tank. However, the sections ideally are not attached at the uppermost and lowermost portions of the tank so as to allow passageways between the outer wall sections. As discussed more fully below, the passageways result in a continuous annular space around the storage tank which can be monitored for leakage.

The bonding technique used to secure outer wall sections 15 to the side walls of the inner tank will depend on the materials of construction of the outer wall sections, per se, and the inner tank wall surface. Adhesive, caulking and welds can be used. Preferably, the wall sections are made of fibrous reinforced resinous material and the bonding is accomplished using an overlay of the same material. When the inner tank is made of metal, it may be necessary to first sand blast the areas of attachment to get good adhesion with the overlays. The overlays can, though need not must, cover the inner wall areas between the wall sections.

Wall caps 17 bridge the outer wall sections. As shown, one side wall of the cap is attached to one wall section and a second side wall of the cap is attached to an adjacent wall section. The wall caps typically have a cardboard core with a fiberglass reinforced resinous outer layer. The wall caps 17 in FIG. 1 are open-bottomed to form a hollow interior area and have a trapezoid shape. Placement and attachment of the wall caps form enclosed spaces 18 with the storage tank 10.

The wall caps when formed in the trapezoid shape act as support ribs. Thus, an angle on the outer wall greatly increases the wall cap's strength. Additionally, bonding of the outer wall sections to the inner tank and bonding of the wall caps to the wall sections results in a structural composite storage tank with enhanced total wall strength. This is due to the inner and outer walls being structurally connected. The result is a storage tank system which is economically built with a minimum of labor intensive steps and which has sufficient strength without excessive wall thickness to meet or exceed mandated structural requirements. The walls of the storage tank system are both able to withstand internal and external load forces encountered during use.

Outer end caps 19 may be preformed, preferably of fiberglass reinforced resinous material and positioned over the inner tank's end walls. A space between the end caps and end walls is provided to receive leaked liquid. As shown, the outer end cap 19 is attached to the side wall of the inner tank and bonded to an endmost wall cap. Alternatively, each of the outer end caps can have its edges attached directly to an outer wall section or wall cap. In all embodiments, the spaced outer wall sections, open-bottom wall caps and outer end caps are secured together in a sealed or a liquid-tight fashion to collectively form an outer containment wall having a ribbed appearance. The outer end caps are preferably directly attached to an end-most wall cap for maximum strength and ease of manufacturing.

Figure 2:
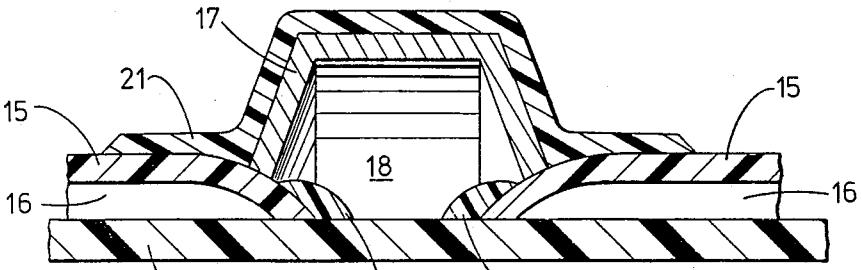
FIG. 2 is an enlarged partial sectional view showing a wall area of the storage tank system taken along line 2—2 of FIG. 1.

One method of forming the wall sections 15 and wall caps 17 depicted in FIGS. 1 and 2 is to initially place solid sheet material around the inner tank's cylinder-shaped body. Examples of such sheets include metal sheets and/or fiberglass/resin sheets. The metal sheet can be a thin gauge steel sheet, preferably with a diamond grid pattern on the surface which faces the inner tank. The fiberglass resin sheet preferably has a stucco appearance on the side facing the inner tank. It is preferred that the solid sheet material has an irregular surface on at least one side to ensure a seal is not formed by its contact with the inner tank walls. A fibrous reinforced resinous overlay 20 is next applied over the edges of the outer wall sections. Wall caps are then properly positioned and additional overlay material 21 applied substantially over them so as to secure each wall cap to adjacent wall sections. FIG. 2 illustrates fibrous reinforced resinous overlay material 21 bonding to outer wall sections 15 and continuing over wall cap 17 to join two outer wall sections and a wall cap together.

Figure 3:
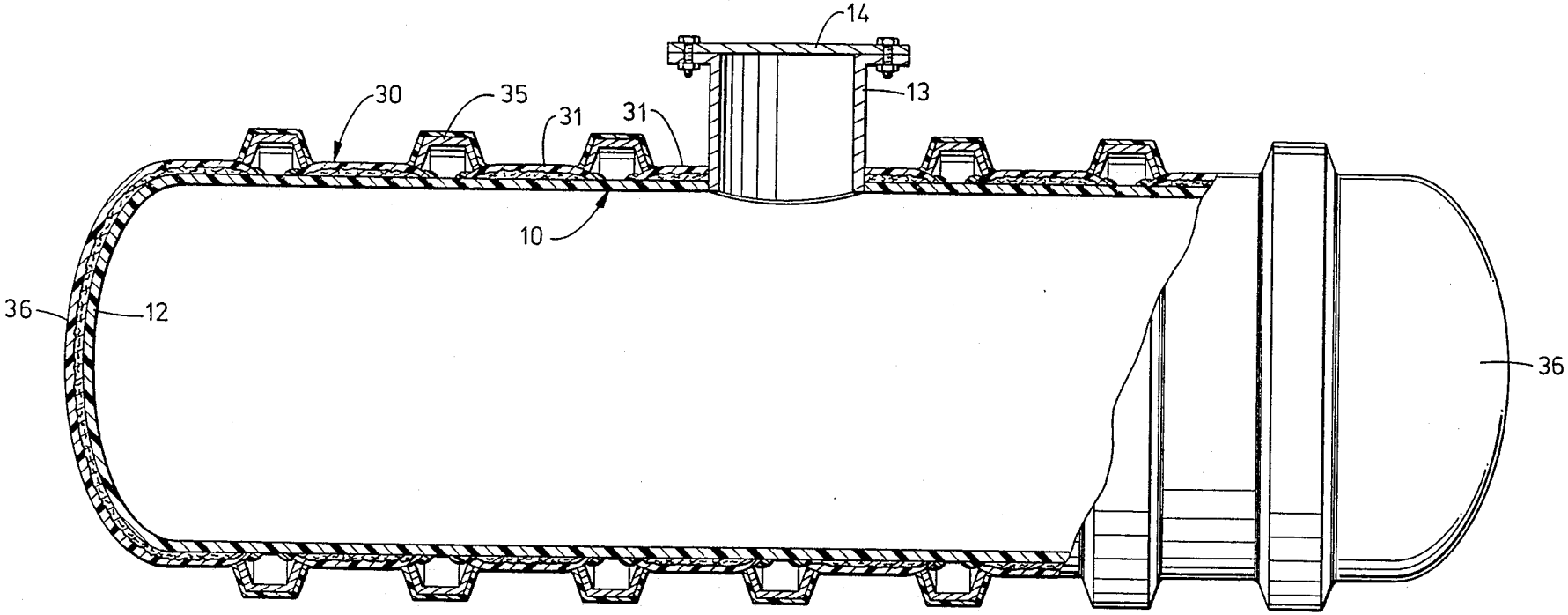
FIG. 3 is another double walled storage tank system of this invention wherein a spacing material is used in formation of the outer wall sections.
Figure 4:
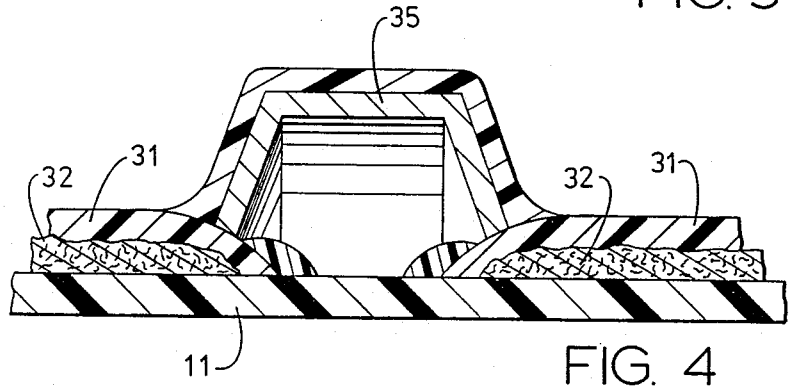
FIG. 4 is an enlarged partial sectional view showing a wall area of the storage tank system taken along line 4—4 of FIG. 3.

Outer containment wall 30 shown in FIGS. 3 and 4 is made of a fibrous reinforced resinous material. The wall sections 31 are formed in one method by first applying spaced layers of fibrous reinforcing material, e.g. fiberglass on the outer surface of the tank 10 and on the end walls 12. The fibrous reinforcing material can take on many different physical shapes and structures, variously referred to as matting, nets, screens, meshes, continuous strands, and chopped strands. Examples of fibrous materials include fiberglass, nylon, and other synthetic fibrous materials. The fibrous material, if in sheet form, is laid onto the storage tank as a continuous matting. Each section has a width and a spacing as described with reference to FIGS. 1–2. The thickness of the fibrous material is great enough that a subsequently applied resinous material will not be able to completely penetrate through it and seal to the inner tank 10. Once the fibrous reinforcing material is applied, a resinous material is next applied to the reinforcing material and thereafter cured. As shown, a fibrous reinforcing material 32 is illustrated with a lower portion as is and an upper portion substantially saturated with resinous material and cured to form wall section 31. If more wall thickness is desired additional resinous material and fibrous reinforcing material may be applied until desired wall thickness is reached.

Several different resinous materials are known for the purpose of reinforcing fibrous material. Such materials include polyesters, e.g. vinylesters, isophthalic polyesters, polyurethane, and polyepoxide. The listed resinous materials used in the construction of the wall sections are not all inclusive, but only illustrative of some of the resinous materials which can be used.

Alternatively, the fibrous material is applied in the form of chopped strands along with the resinous materials described in the previous paragraph. In this embodiment, a separating material discussed in following paragraphs must be applied to the inner tank walls where the sections are to be formed to keep the inner and outer walls separated. The separating material is spaced on the tank's cylinder area in a manner to create attachment areas or a compression seal from the shrinkage of the resin upon curing. Thus, the chopped strand and resinous material are sprayed from separate nozzles of the same spray gun and form the spaced outer wall sections as the resin cures. The overlapping of spray and fibrous material forming the sections on the inner tank wall adheres to the inner tank at the edges of the sections. Still another method of forming the outer wall sections is by filament windings. In this method continuous reinforcing fibrous strands are impregnated with resinous material and then wrapped in a crossing pattern over the inner tank. A separating material means must be used in this method also.

When needed, a separating material having an least partially impervious outer planar surface is applied in spaced sections to the surface area on the inner tank's outer surface including end walls 12. The purpose of the separating material is to ensure that the subsequently applied fibrous reinforcing material and resinous material which form the wall sections and outer end caps will not seal to the inner storage tank.

Separating materials include solid polymeric films, corrugated sheets, irregular surfaced sheets, and foraminous or porous materials which are sealed on at least one side. Many pliable or semi-rigid materials are usable. Examples of such material are polyethylene, jute, polyurethane foam, polyester foam, polyether foam, fiberglass matting, cotton matting, nylon matting, corrugated cardboard, steel sheets with an irregular surface, fiberglass resinous sheets with an irregular surface, and asbestos which range from about 0.01 inches to almost 1.0 inch in thickness. A heat seal or sealing material, e.g. a polymeric coating, or a impervious wrapping such as polyethylene sheeting is used on one surface of any foraminous materials when needed to prevent substantial saturation with a subsequently applied resinous material. Wax, which is subsequently heated and removed, is also used as a separating material.

The minimum thickness of the separating material must be sufficient to prevent the subsequently applied wall section from adhering to the storage tank. Accordingly, any shrinkage resulting from formation of the wall section must be accounted for by having a sealed material thick enough to be partially collapsed, but not form a compression seal between the walls.

Subsequent placement of wall caps 35 over adjacent outer wall sections 31, use of overlays, and attachment of outer end caps 36 as described with reference to FIGS. 1–2 is next done. The resultant outer containment wall is a fibrous reinforced resinous material comprised of outer wall sections 31, wall caps 35 and outer end caps 36.

Figure 5:
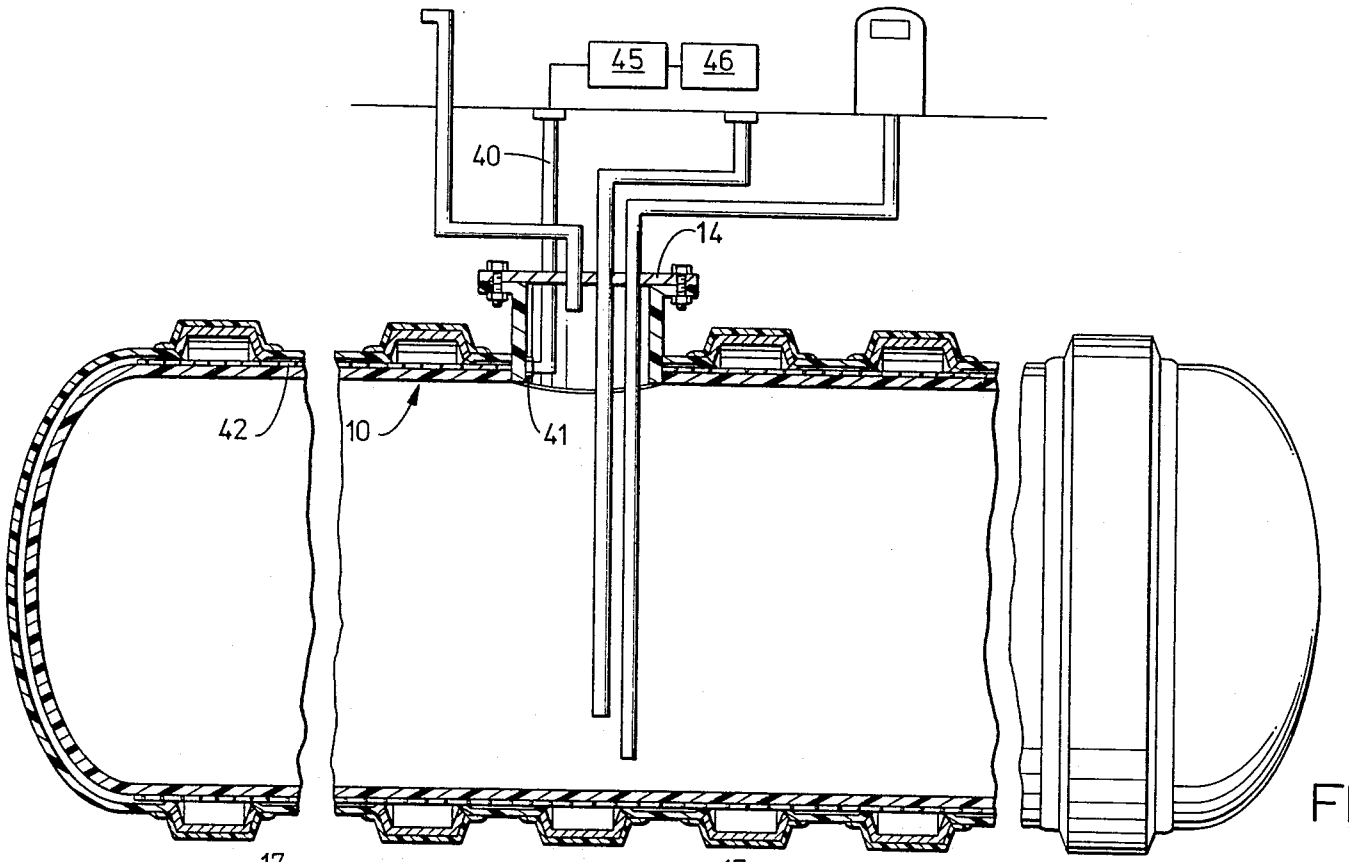
FIG. 5 is a side view of a storage tank system of this invention illustrating the use of monitor means.
Figure 6:
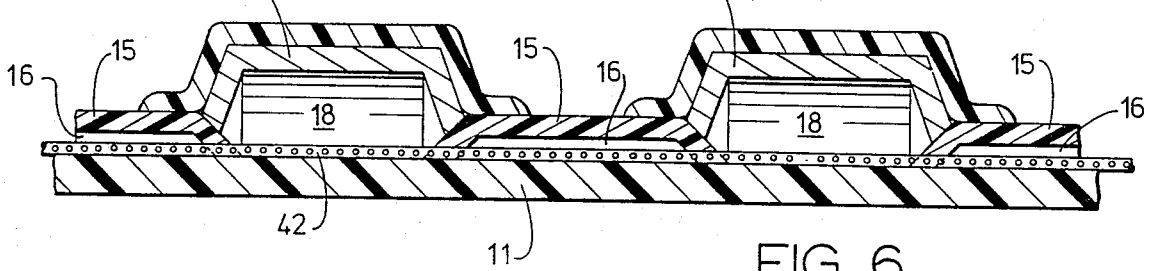
FIG. 6 is an enlarged partial sectional view of a wall area of the storage tank system taken along line 6—6 of FIG. 5.

With reference to FIGS. 5 and 6 there is shown a storage tank 10 of the type described in FIG. 1 wherein the open spaces between the walls are monitored. An access tube 40 extends from ground level through manway lid 14 and access hole 41 so as to be in communication with the open spaces. Preferably, the spaces enclosed by the outer wall sections 15 and the wall caps 17 are in communication. This is accomplished in one method by laying at least one aperture tube 42 along the length of the inner tank 10 prior to forming the outer wall sections thereon. Subsequent steps of securing the sections to the inner tank, and forming the outer containment wall are done in a fashion above described. Preferably, at least two aperture tubes are used with one being positioned along the bottom of the tank and one along the top of the tank. Alternatively, a tube or rod is used in place of the aperture tube and removed after the final wall section is formed. Vacuum can be used to collapse the walls of the tube to facilitate its removal. The result being a tank system with a tunnel extending the length of the inner tank's outside surface. Still other ways can be used to provide communication throughout the enclosed areas.

Secondary containment of liquid stored in storage tank 10 is provided by the outer wall sections 15, wall caps 17 and outer end caps 19. Monitoring of the closed annular space is readily accomplished when said containment space is continuous. The aperture tube and access openings provides the method of communication of the containment annular spaces.

Any of well know and commercially available monitor means are used for monitoring the spaces between ribs or the total containment space. For example, the closed space can be placed either under a non-atmospheric pressure, i.e. a positive or negative air pressure. Detection means associated with the closed space is capable of detecting any change in pressure resulting from a leak in the overlay or the storage tank. As shown in FIG. 5, there is provided a means for maintaining the closed space under a negative pressure. Conventional vacuum pump 45, together with an associated pressure regulator can be used. A pressure change sensor 46 is a part of the detection means. A pressure gauge 1 serves this purpose adequately. Optionally, an alarm system can be electronically linked with the pressure sensor to audibly or visually warn of a preset significant pressure change. A vacuum is preferred because of a resultant increased composite strength of the storage tank system by drawing the inner and otter walls 2 together.

Another embodiment of the detection means utilizes an analyzer capable of detecting the liquid being stored. Thus, the detection means comprises the analyzer which is communication with closed annular space. Preferably, a vacuum means for withdrawing gaseous 2 material from the closed space is used for the purpose of obtaining a sample. Thus, in FIG. 5, element 46 is an analyzer capable of detecting selected liquids instead of a pressure change sensor.

Still another detection means utilizes a probe which extends through the access tube so as to monitor for leakage at or near the bottom of the closed annular space. The probe is capable of detecting preselected liquids or gases. In this embodiment, leakage will ultimately seep to the bottom of the closed annular space and e detected. Detecting liquid can also be used as part of a detection means. Thus, a non-polluting liquid is used to fill the closed annular spaces and an access tube is installed leading to ground level. A sight glass at the access tube's end allows a visual observation of any change in detecting liquid level.

All the leak detection means discussed above can be electronically linked with an alarm system to audibly or visually warn of a pre-set significant change in the closed annular spaces: The leak detection means and secondary containment means allow for an early warning of a deterioration of either the primary or secondary containment means thereby permitting the necessary repair work to be done before any significant soil or water contamination has occurred.

While the invention has been described with respect to preferred embodiments, it is understood that various modifications may be made without departing from the spirit of the subject invention as defined by the appended claims. For example, the wall caps can be spaced laterally around the inner tank instead of circumventually. The wall caps, themselves, can be substantially flat or any geometric shape desired including square, rounded or trapezoidal-shaped. The wall sections can also be formed such that the top surface of the inner tank is exposed to allow a convenient means of attaching various access lines. All obvious variations are within the scope of the claims.

What is claimed is:

1. A method of building a double walled storage tank system having a ribbed appearance wherein an inner storage tank and an outer containment wall utilize a common set of wall caps for enhanced composite strength, comprising the steps of:

(a) forming a series of spaced outer wall sections over a cylindrical-shaped inner storage tank having side walls and end walls wherein each of said outer wall sections extends circumferentially around the side walls of the inner storage tank and is at least partially attached along its edges to the inner storage tank so as to form an open area thereunder for the purpose of receiving liquid which may leak through the inner storage tank's walls;

(b) attaching open-bottom wall caps over the spaced outer wall sections such that a first side wall of each wall cap is attached to a formed spaced outer wall section and a second side wall of the wall cap is attached to an adjacent formed spaced outer wall section so as to bridge an area between the formed spaced outer wall sections; and (c) forming an outer end cap over each end wall of the cylindrical-shaped inner storage tank, each of said outer end caps spaced from the end walls in a manner such that the spaced outer wall sections, open-bottom wall caps and outer end caps are all secured together in a liquid-tight fashion to collectively form the outer containment wall, said storage tank system characterized in that the wall caps strengthen both the inner storage tank wall and the outer containment wall against external and internal load forces.

2. The method of claim 1 wherein the outer wall sections are formed at a distance less than about four inches in height from the inner tank wall.

3. The method of claim 1 wherein each outer wall section is from about eight inches to about sixty inches in width.

4. The method of claim 3 wherein each outer wall section is from about twelve inches to about thirty-six inches wide.

5. The method of claim 4 wherein the wall section are formed of fibrous reinforcing material and resinous material.

6. The method claim 1 further comprising the step of placing a separating material on the inner storage tank at least where the outer wall sections are to be formed providing a means whereby the outer wall sections remain independent of the inner storage tank other than where the wall sections are attached thereto.

7. The method of claim 6 wherein the separating material is sealed on at least one side to prevent substantial migration of resinous material therethrough to reach the inner storage tank.

8. The method of claim 7 wherein the separating material is a foam, matting, net, screen or mesh which has its outer surface sealed.

9. The method of claim 1 wherein the open areas under the wall caps and outer wall sections are provided with access openings for communication so as to allow continuous monitoring of the storage tank wall and outer containment wall to detect leakage.

10. The method of claim 1 wherein the outer wall sections are formed from solid sheet materials.

11. A double walled storage tank system having an inner storage tank and an outer containment wall with a common set of wall caps for enhanced composite strength, comprising:

(a) a cylindrical-shaped inner storage tank having side walls and end walls for holding liquid; and (b) an outer containment wall at least partially separated from the inner storage tank, said outer containment wall comprised of a series of outer wall sections circumferentially extending around and at least partially bonded to the inner storage tank, open-bottom wall caps attached to adjacently spaced outer wall sections and outer end caps over the inner storage tank's end walls, all secured together in a liquid-tight fashion to collectively form the outer containment wall.

12. The storage tank system of claim 11 wherein the outer wall sections are less than about four inches in height from the inner storage tank.

13. The storage tank system of claim 12 wherein the wall caps are secured to the outer wall sections by a fibrous reinforced resinous material.

14. The storage tank system of claim 13 wherein the outer wall sections are made of fibrous reinforcing material and resinous material.

15. The storage tank system of claim 14 further wherein a separating material is positioned under each outer wall section.

16. The storage tank system of claim 15 wherein the separating material is sealed on at least one side.

17. The storage tank system of claim 16 wherein the separating material is a foam, matting, net, screen or mesh.

18. The storage tank system of claim 12 wherein the outer wall sections are made from solid sheet materials.

19. The storage tank system of claim 12 wherein each outer wall section is about eight inches to about sixty inches in width.

20. The storage tank system of claim 19 wherein each outer wall section is about twelve inches to about thirty-six inches in width.

21. The storage tank system of claim 20 wherein each outer wall section is about fourteen inches to about twenty inches in width.

22. The storage tank system of claim 12 wherein means are provided in each wall cap so that the spaces enclosed by the wall caps and the spaces covered by the outer wall sections are in communication with one another.

23. The storage tank system of claim 22 further comprising monitor means in communication with at least one of the enclosed spaces for the purpose of detecting a leak in the inner storage tank or outer containment wall.

24. The storage tank system of claim 11 wherein the end caps are each flat.

25. The storage tank system of claim 11 wherein the end caps are each domed-shaped.

* * * * *